US005792734A

United States Patent [19]

Mueller et al.

[11] Patent Number: 5,792,734

[45] Date of Patent: Aug. 11, 1998

[54] SLIP ENHANCER COMPOSITION FOR PRINTING PRESS OPERATIONS

[75] Inventors: Raymond J. Mueller, Plymouth; Ted H. Sliwinski, Dearborn Hts., both of Mich.

[73] Assignee: Flint Ink Corporation, Ann Harbor, Mich.

[21] Appl. No.: 631,980

[22] Filed: Apr. 15, 1996

[51] Int. Cl.[6] ..... C10M 173/02

[52] U.S. Cl. ..... 508/451; 508/579; 106/15.05; 106/18.29; 106/157.1; 106/271

[58] Field of Search ..... 106/15.05, 18.29, 106/157.1, 271; 508/451, 579

[56] References Cited

U.S. PATENT DOCUMENTS

| | | | |
|---|---|---|---|
| Re. 34,329 | 8/1993 | Baker et al. | 106/271 |
| Re. 34,647 | 6/1994 | Baker et al. | 106/271 |
| 4,451,376 | 5/1984 | Sharp | 210/701 |
| 4,541,340 | 9/1985 | Peart et al. | 101/470 |
| 4,657,590 | 4/1987 | Gamblin | 106/22 |
| 4,663,061 | 5/1987 | Kuwamoto et al. | 252/32.5 |
| 4,693,839 | 9/1987 | Kuwamoto et al. | 252/51.5 A |
| 4,855,070 | 8/1989 | Lewis | 252/75 |
| 4,874,466 | 10/1989 | Savino | 162/164.3 |
| 4,954,556 | 9/1990 | Bull et al. | 524/378 |
| 5,008,144 | 4/1991 | Baker et al. | 428/211 |
| 5,035,946 | 7/1991 | Baker et al. | 428/327 |
| 5,223,097 | 6/1993 | Hassler | 162/161 |
| 5,302,193 | 4/1994 | Wouch et al. | 106/20 R |
| 5,308,890 | 5/1994 | Snyder | 523/201 |
| 5,344,675 | 9/1994 | Snyder | 427/388.4 |
| 5,344,872 | 9/1994 | Debord et al. | 524/513 |
| 5,376,170 | 12/1994 | Baker | 106/271 |

*Primary Examiner*—Jerry D. Johnson
*Attorney, Agent, or Firm*—Dinnin & Dunn, P.C.

[57] ABSTRACT

The disclosure deals with a slip enhancer composition for use in printing operations, such as web heatset and gravure printing operations, said composition comprising: (a). about 0.05% to about 7% by weight of a water soluble polymer having an average molecular weight above about 20,000, (b) about 0.01% to about 7% by weight of a biocide agent to assist in preventing rancidity and for stabilizing of the composition, (c) 0.01% to about 25% by weight of water dispersible wax, (d) 0.01% to about 10% by weight of a surfactant to assist as a defoamer/anti-static agent for the composition, (e) 0.02% to about 20% by weight of an olfactory agent, and a liquid carrier as the balance of the composition.

10 Claims, 1 Drawing Sheet

SLIP ENHANCER COMPOSITION FOR PRINTING PRESS OPERATIONS

BACKGROUND OF THE INVENTION

This invention broadly relates to a new slip enhancer composition for use in web heatset printing operations and gravure printing press operations, or for other printing press operations. In the past, slip compositions for this purpose have been primarily silicone containing compositions and, while those silicone containing compositions did a reasonable job in acting as a slip enhancer, there were definite problems associated with such silicone containing compositions in that they often left a greasy film or marred the surface of the printed material prior to and during delivery operations. Moreover, silicones have caused bleeding or fading of some colors after application of the slip composition. In addition prior silicone containing compositions caused somewhat of a dragging problem during delivery operations. Slip compositions are typically used in printing operations (e.g., web heatset or publication gravure printing operations) on the folders, turn bars, and/or gate folders wherein a contact slip enhancer is needed with little to no interaction with the printed substrate which is being passed through the printing operation. These slip enhancer compositions, as known to those skilled in the art, are used as in-line wet film agents preceding such folders or turning bars.

Accordingly, it is a primary object of this invention to provide a new slip enhancer composition for use in printing operations which overcomes those problems associated with prior silicone containing slip enhancer compositions.

Another object of the present invention is to provide a new and highly advantageous slip enhancer composition that does not contain any silicone materials.

Another object of the present invention is to provide a new slip enhancer composition which improves the rub characteristics of the printed substrate material and which does not contain any silicones, and which will reduce the possibility of damage during shipping of the printed material due to marring or rubbing characteristics which had a tendency to cause such damage in the past.

Another object of the present invention is to provide a new slip enhancer composition which is silicone-free and which provides excellent lubricity to the printed material during the delivery operations, and which does not leave a greasy film or mar the surface of the printed material like prior silicone containing materials.

Another object of the present invention is to provide a new slip enhancer composition which creates a smoother drag during delivery operations.

Other objects, features and advantages of the present invention will become apparent from the subsequent description and the appended claims.

SUMMARY OF THE INVENTION

This invention concerns a new and novel slip enhancer composition for use in printing operations, such as web heatset and gravure printing operations, with the inventive composition comprising: (a) about 0.05% to about 15% by weight of a water soluble polymer having an average molecular weight above about 20,000, (b) about 0.01% to about 7% by weight of a biocide agent to assist in preventing rancidity and for stabilizing of the composition, (c) zero to about 25% by weight of water dispersible wax, (d) zero to about 10% by weight of a surfactant to assist as a defoamer/anti-static agent for the composition, (e) zero to about 20% by weight of an olfactory agent, and a liquid carrier as the balance of the composition. The water soluble polymer should preferably be a material selected from at least one member of the group consisting of an ethylene oxide polymer, a vinyl/maleic anhydride polymer, a protein polymer, an acrylic polymer, and a polyvinyl alcohol polymer; and more preferred results are obtained with one of the group of an ethylene oxide polymer, a vinyl/maleic anhydride polymer, an acrylic polymer, and a polyvinyl alcohol polymer. Best results are obtained with an ethylene oxide polymer.

DESCRIPTION OF THE BEST MODE AND PREFERRED EMBODIMENTS OF THE INVENTION

Figure 1:
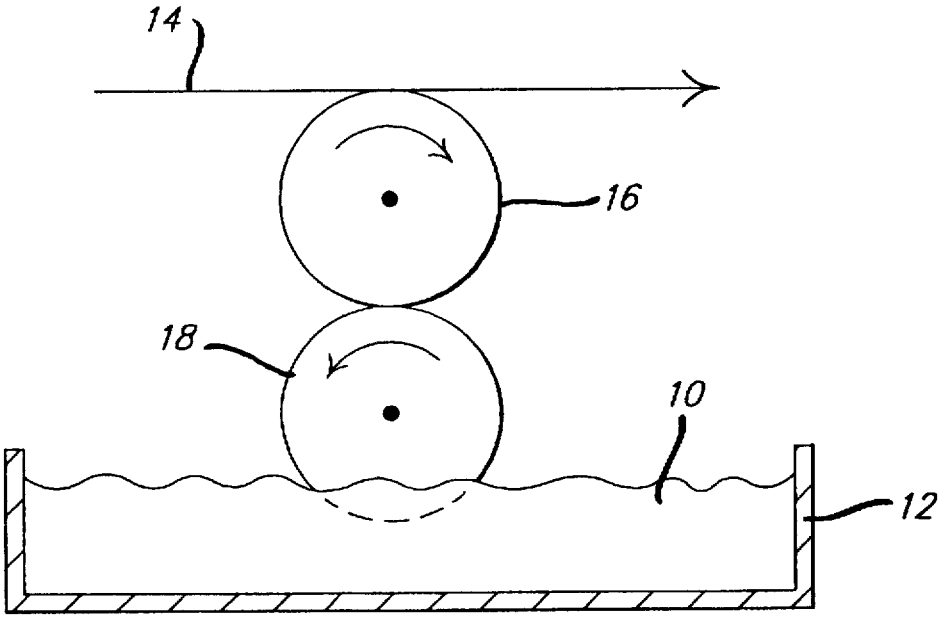
FIG. 1 illustrates a Dahlgren coater wherein the composition of the invention may be applied from a liquid bath containing the composition through a series of rollers onto one side of a paper web at any desired point in the printing operation through which the paper web is passing; and, FIG. 2 illustrates another embodiment of the invention involving a typical roll coater wherein the composition of the invention is applied from a liquid bath to a paper web which is passing through the printing operation.

In FIG. 1, the composition of the invention is designated 10 and is present within a container 12 which holds the liquid composition 10. The paper web is designated 14 and as will be apparent, particularly to those skilled in the art, the paper web is coated with the composition 10 through the carrying action of the two rollers 16 and 18, the latter roller 18 acting to pick up the liquid composition 10 from the container 12 and transfer the liquid composition onto the roller 16, which in turn transfers and applies the coating 10 to the paper web 14 at any stage where necessary during the printing operation.

Figure 2:
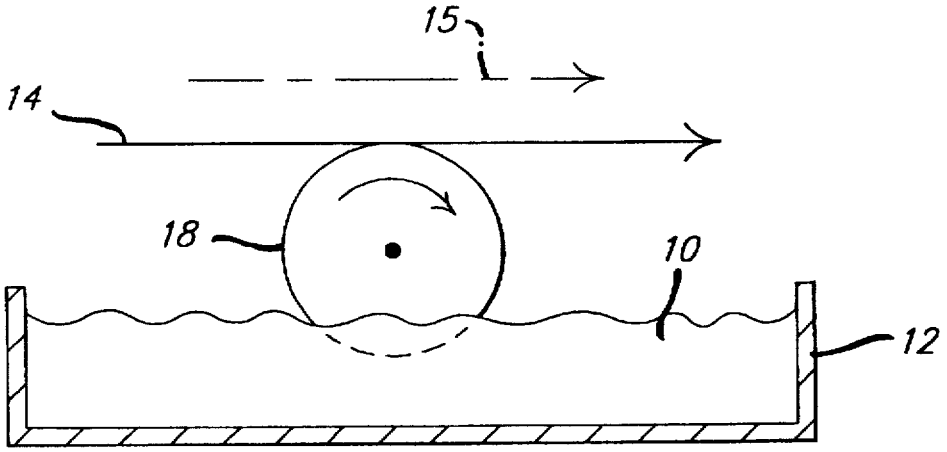

In FIG. 2, which illustrates a typical roll coater apparatus, known to those skilled in the art, the liquid composition 10 is applied from the bath container 12 onto the roller 18 which in turn transfers the liquid composition 10 onto the paper web 14 as it passes through any desired stage of the printing operation. In FIG. 2, the web speed 15 (i.e. the speed of the paper web) is designated by the dotted line arrow. Typically, the speed of rotation of the cylinder 18 in FIG. 2 is slower than the web speed 15. However, as may be apparent to those skilled in the art, the cylinder speed can be adjusted as desired to control the film thickness of the liquid composition 10 applied to the web 14.

The water soluble polymer used in the invention should, broadly stated, have an average molecular weight above about 20,000. Preferably its average molecular weight should be between about 90,000 and about 1.5 million; with best results being obtained when said molecular weight is between about 500,000 and about 700,000. The water soluble polymer should, broadly stated, be present within the range of about 0.05% to about 15% by weight of the inventive composition; and preferably within the range of about 0.1% to about 4% by weight; with best results being obtained when the water soluble polymer is present at a level of about 0.5% by weight of the composition. Typical materials which may be used as the water soluble polymer are the Polyox® materials available from Union Carbide Corporation. A particularly suitable material is Polyox® WSR205. Alternate water soluble polymers which may be used are: Gantrez AN-119 (vinyl/maleic anhydride polymer), WSR-N-80 (polyethylene oxide polymer), WSR-1105 (polyethylene oxide polymer), Vinol 523 (polyvinyl alcohol polymer), Elvanol 71-30 (polyvinyl alcohol polymer), Procote 5000 (protein polymer), and Carboset 515 (acrylics/acrylate polymer).

The biocide agent which is used in the composition should, broadly stated, be present within the range of about 0.01% to about 7% by weight of the composition; and, preferably it should be maintained within the range of about 0.05% to about 4% by weight, with best results being obtained at a level of about 0.5% by weight of the biocide agent in the composition. The biocide agent is used to assist in preventing the occurrence of rancidity and also for assisting in stabilizing the composition.

The biocide agent is preferably a material such as PROXEL® GXL which is a liquid preservative for aqueous systems; and, is available from ICI Americas Inc., of Wilmington, Del. PROXEL® GXL is an aqueous solution of dipropylene glycol and 1,2 benzisothiazolin-3-one. It is a clear or faintly turbid dark brown-colored liquid having a viscosity of 350 centipoise at 25° C., and a specific gravity of 1.13 at 20° C.

The water dispersible wax used in the composition should be present within the broad range of zero to about 25% by weight of the composition, with preferred results being obtained when the water dispersible wax is present within the range of about 0.1% to about 12% by weight of the composition. Best results have been obtained when the water dispersable wax is used at a level of about 1.3% by weight of the composition. The water dispersable wax is a finely particulated wax solids material which is dispersible or emsulfiable in water or other liquid carrier materials as described in the invention. A preferred material for use as the water dispersable wax is Jonwax-26 (from Johnson Wax Co.). Other suitable wax materials which may be used are: Microsperse 411 (PE/PTFE), Neptune I-SP5 (PE (polyethylene wax), Aqua Polyfluo 411 (PE/PTFE), Neptune 5223 (PE), Neptune 5331 (PE/PTFE), 316-N-30A (polywax emulsion), AquPoly 250 (PE), and Flexoslip II (PE).

The surfactant used in the inventive composition should, broadly stated, be present from zero to about 10% by weight of the composition; and preferably within the range of about 0.01% to about 6% by weight of the composition; with best results having been obtained when the surfactant is present at a level of 2.5% by weight of the composition. The surfactant acts a defoamer and also appears to act as an anti-static agent in the usage of the composition. A particularly preferred surfactant for use in the invention is Surfynol-440. Other surfactants which may be used are: Foamaster V (non ionic), Colloid 99 (polymeric non ionic), DEE FO 1-A (hydrocarbon/fatty material), Colloid 60 (polymeric non ionic), and Foamaster H (non ionic).

The olfactory agent used in the invention should, broadly stated, be present within the range of zero to about 20% by weight of the composition; with preferred results being obtained when it is present within the range of about 0.02% to about 10% by weight of the composition. Best results are obtained using an olfactory agent at a level of about 0.5% by weight of the composition. The olfactory agent acts as an agent which adds, covers up, and/or eliminates certain smells or odors which may be present in the composition. Suitable olfactory agents which may be used in the inventive composition are: P-475 Strawberry, 045 Rose, 83622 Pine, 112 328 Strawberry, Santomask II, Vanillan USP, X-O Oder Neutralizer, Pine 3219, 4618 New Car, and 997035 Lilac.

The liquid carrier used for the composition makes up the balance thereof. Preferably the liquid carrier is water; however, other liquid carriers may be used such as glycols, alcohols, ketones, and esters. Best results are obtained when the liquid carrier is comprised substantially of water. Broadly stated, the liquid carrier should be present within the range of about 30% to about 99% by weight of the composition. Preferably it should be present within the range of about 60% to about 99% by weight of the composition; and, best results are obtained when the liquid carrier is present within the range of about 80% to about 99% by weight of the composition.

In order to further illustrate the invention, the following examples are provided. It is to be understood, however, that the examples are included for illustrative purposes and are not intended to be limiting of the scope of the invention as set forth in the subjoined claims.

EXAMPLE 1

| | % wgt. |
|---|---|
| Polyox WSR 205 | 0.5 |
| 316-N-30A Wax Dispersion | 5.0 |
| Surfynol 440 | 2.5 |
| GXL | 0.5 |
| Olfactory Agent (Nutra-Scent ™) WSP-1717 | 0.5 |
| Water | 91.0 |
| | 100.00 |

[For Press Ready Material, reduce to 20% with clean water.]

EXAMPLE 2

| | % wgt. |
|---|---|
| Gantrez AN-119 | 0.5 |
| Jonwax-26 | 5.0 |
| GXL | 0.5 |
| Foamaster V | 2.5 |
| Water | 91.5 |
| | 100.00 |

EXAMPLE 3

| | % wgt. |
|---|---|
| Gantrez AN-119 | 0.5 |
| Jonwax-26 | 5.0 |
| GXL | 0.5 |
| Foamaster V | 2.5 |
| Fragrance 4533-HAX-Green(S) | 0.5 |
| Water | 91.0 |
| | 100.00 |

EXAMPLE 4

| | % wgt. |
|---|---|
| Polyox WSR 205 | 0.5 |
| Neptune 5331 | 10.0 |
| Surfynol 440 | 2.5 |
| GXL | 0.5 |
| RZW00070 | 0.5 |
| Water | 86.0 |
| | 100.00 |

EXAMPLE 5

| | % wgt. |
|---|---|
| Polyox WSR 205 | 0.5 |

-continued

| | % wgt. |
|---|---|
| 316-N-30A Wax Dispersion | 5.0 |
| Surfynol 440 | 2.5 |
| GXL | 0.5 |
| Water | 91.5 |
| | 100.00 |

EXAMPLE 6

| | % wgt. |
|---|---|
| Polyox WSR 205 | 0.5 |
| Water | 99.5 |
| | 100.00 |

EXAMPLE 7

| | % wgt. |
|---|---|
| Polyox WSR 205 | 0.5 |
| Jonwax-26 | 5.0 |
| Water | 94.5 |
| | 100.00 |

EXAMPLE 8

| | % wgt. |
|---|---|
| Polyox WSR 205 | 0.5 |
| Jonwax-26 | 5.0 |
| GXL | 0.5 |
| Water | 94.0 |
| | 100.00 |

[For Press Ready Material, reduce to 20% with clean water.]

EXAMPLE 9

| | % wgt. |
|---|---|
| Water | 91.0 |
| Polyox WSR205 | 0.5 |
| Jonwax-26 | 5.0 |
| Biocide GXL | 0.5 |
| Surfynol 440 | 2.5 |
| Olfactory Agent | 0.5 |
| (Nutra-Scent ™) WSP-1717 | |
| | 100.00 |

[For Press Ready Material, reduce to 20% with clean water.]

EXAMPLE 10

| | % wgt. |
|---|---|
| Polyox WSR 205 | 0.5 |
| Jonwax-26 | 15.0 |

-continued

| | % wgt. |
|---|---|
| Colloid 60 | 2.5 |
| GXL | 0.5 |
| Santomask II | 0.5 |
| Water | 81.0 |
| | 100.00 |

[For Press Ready Material, reduce to 20% with clean water.]

EXAMPLE 11

| | % wgt. |
|---|---|
| Vinol 523 | 3.0 |
| Water | 97.0 |
| | 100.00 |

EXAMPLE 12

| | % wgt. |
|---|---|
| Vinol 523 | 3.0 |
| Surfynol 440 | 2.5 |
| Water | 94.5 |
| | 100.00 |

EXAMPLE 13

| | % wgt. |
|---|---|
| Vinol 523 | 3.0 |
| Surfynol 440 | 2.5 |
| Jonwax-26 | 5.0 |
| Water | 89.5 |
| | 100.00 |

EXAMPLE 14

| | % wgt. |
|---|---|
| Procote 5000 | 20.0 |
| GXL Biocide | 0.5 |
| Water | 79.5 |
| | 100.00 |

EXAMPLE 15

| | % wgt. |
|---|---|
| Procote 5000 | 10.0 |
| GXL Biocide | 0.5 |
| Polyox WSR 205 | 1.5 |
| Water | 88.0 |
| | 100.00 |

EXAMPLE 16

| | % wgt. |
|---|---|
| Procote 5000 | 10.0 |
| GXL Biocide | 0.5 |
| Elvanol 71-31 | 1.5 |
| Water | 88.0 |
| | 100.00 |

EXAMPLE 17

| | % wgt. |
|---|---|
| Procote 5000 | 10.0 |
| GXL Biocide | 0.5 |
| Polyox WSR 205 | 1.5 |
| Surfynol 440 | 2.5 |
| Water | 85.0 |
| | 100.00 |

EXAMPLE 18

| | % wgt. |
|---|---|
| Procote 5000 | 10.0 |
| GXL Biocide | 0.5 |
| Carboset 515 | 1.5 |
| Surfynol 440 | 2.5 |
| Pine 3219 | 0.5 |
| Water | 85.0 |
| | 100.00 |

While it is not completely understood as to the why the inventive composition provides such advantageous and unique characteristics, it has been found that the slip enhancer composition of the invention is highly advantageous because it is silicone-free and because it provides excellent lubricity to the printed material during the delivery operations and yet it does not leave a greasy film or mar the surface of the printed material, magazines or books, such as has occurred with silicone containing compositions in the past. In addition, the slip enhancer composition of the invention creates a much smoother drag in delivery operations, as opposed to a jerky motion that was normally observed with prior slip enhancer compositions utilizing silicone additives. Still further, the novel composition of the invention provides a slip enhancer formulation that does not contain any silicone and which is suitable for use with folders, turn bars, gate folders, and the like where a contact slip enhancer is necessary and yet which provides little to no adverse interaction with the printed substrate passing through the printing operation.

While it will be apparent that the preferred embodiments of the invention disclosed are well calculated to fulfill the objects, benefits, and advantages of the invention, it will be appreciated that the invention is susceptible to modification, variation and change without departing from the proper scope or fair meaning of the subjoined claims.

What is claimed is:

1. A slip enhancer composition for use in printing operations, such as web heatset and gravure printing operations, said composition comprising:

(a) about 0.05% to about 15% by weight of a water soluble polymer having an average molecular weight above about 20,000, and wherein said water soluble polymer is selected from at least one member of the group consisting of an ethylene oxide polymer, a vinyl/maleic anhydride polymer, a protein polymer, an acrylic polymer, and a polyvinyl alcohol polymer, (b) about 0.01% to about 7% by weight of a biocide agent to assist in preventing rancidity and for stabilizing of the composition, (c) zero to about 25% by weight of water dispersible wax, (d) zero to about 10% by weight of a surfactant to assist as a defoamer/anti-static agent for the composition, (e) zero to about 20% by weight of an olfactory agent, and a liquid carrier as the balance of the composition.

2. The composition of claim 1 further characterized as having the following percentages by weight, (a) about 0.05% to about 15%, (b) about 0.01% to about 7%, (c) about 0.01% to about 25%, (d) about 0.01% to about 10%, (e) about 0.02% to about 20%.

3. The composition of claim 1 wherein, said molecular weight is between about 20,000 and about 3,000,000.

4. The composition of claim 3 further characterized as having the following percentages by weight, (a) about 0.5%, (b) about 0.5%, (c) about 1.3%, (d) about 2.5%, (e) about 0.5%, and said molecular weight is between about 500,000 and about 700,000.

5. The composition of claim 3 wherein, said liquid carrier is comprised of water.

6. The composition of claim 1 further characterized as having the following percentages by weight, (a) about 0.1% to about 4%, (b) about 0.05% to about 4%, (c) about 0.01% to about 12%, (d) about 0.01% to about 6%, (e) about 0.02% to about 12%.

7. The composition of claim 1 wherein, said molecular weight is between about 90,000 and about 1,500,000, and said water soluble polymer is an ethylene oxide polymer.

8. The composition of claim 7 wherein, said liquid carrier is comprised of water.

9. The composition of claim 1 wherein, said liquid carrier is at least one member selected from the group consisting of water, a glycol, an alcohol, an ester, and a ketone.

10. The composition of claim 1 wherein, said liquid carrier is comprised of water.

* * * * *